US005165630A

United States Patent [19]

Connor

[11] Patent Number: 5,165,630

[45] Date of Patent: Nov. 24, 1992

[54] WRIST PROTECTOR

[76] Inventor: Martin D. Connor, 206 Harvard St., Cambridge, Mass. 02139

[21] Appl. No.: 741,803

[22] Filed: Aug. 6, 1991

[51] Int. Cl.[5] ..... B43L 15/00

[52] U.S. Cl. ..... 248/118.1; 400/715

[58] Field of Search ..... 248/118, 118.1, 118.3, 248/118.5, 205.2; 273/438, DIG. 30, 338; 400/715

[56] References Cited

U.S. PATENT DOCUMENTS

| | | | |
|---|---|---|---|
| 105,001 | 7/1870 | Sanborn | 248/118.5 |
| 4,313,585 | 2/1982 | Bricker | 248/118.5 |
| 4,973,176 | 11/1990 | Dietrich | 400/715 |
| 5,022,622 | 6/1991 | Schaevitz | 248/118 X |
| 5,056,743 | 10/1991 | Zwar et al. | 248/118 |

*Primary Examiner*—Ramon O. Ramirez
*Attorney, Agent, or Firm*—Lyon & Lyon

[57] ABSTRACT

Wrist protector for a computer mouse which includes a sized pad having an upper surface and a lower surface connected together by at least one side wall. A portion of the side wall is adapted for fixation to the computer mouse. The lower surface is formed from a planar friction free material adapted to slide on a separate planar surface. The upper surface is formed from a cushioning material. The pad has a thickness which elevates a wrist placed on the pad from the separate planar surface and the pad is sized for fixation to the mouse and is of sufficient length in which to hold a portion of the wrist of a hand holding a mouse fixed to the pad.

7 Claims, 1 Drawing Sheet

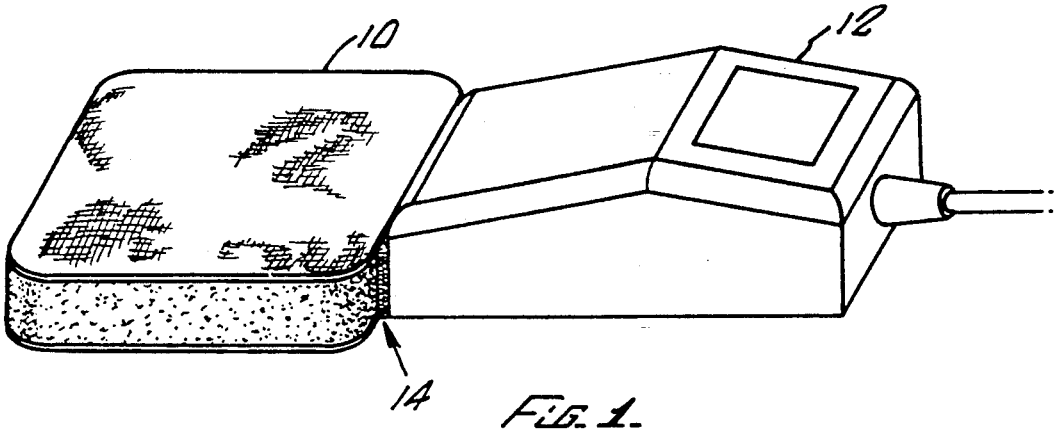
FIG. 1.
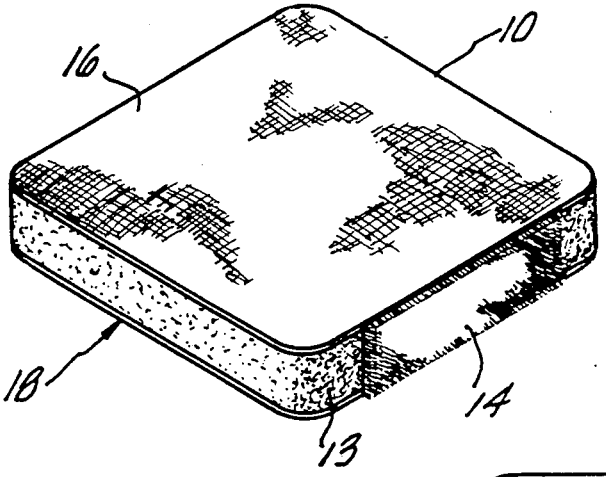
FIG. 2.
FIG. 3.
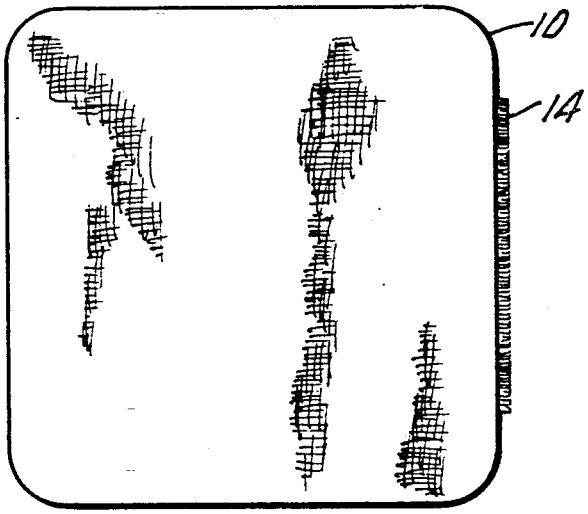
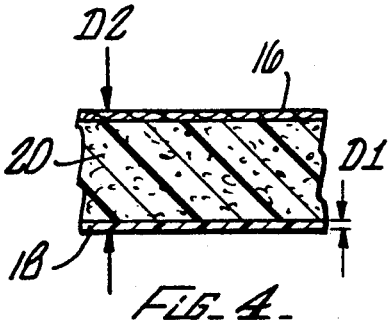
FIG. 4.

WRIST PROTECTOR

BACKGROUND OF THE INVENTION

This invention relates to accessories for a computer mouse.

SUMMARY OF THE INVENTION

This invention provides an accessory for a computer mouse which provides ergonomic support to the user during use of the mouse. In general, the invention features a pad which can be attached to a computer mouse, and provides support for the wrist of the hand used to move the computer mouse. The wrist is elevated in a manner which allows the wrist to be held relatively straight, and thus reduces stress on tendons controlling the wrist and hand. Unlike prior methods for using a mouse (in which the wrist is generally dragged along the upper surface of, e.g., a desk top), the pad is provided with a friction-free lower surface to allow ready movement of the mouse along a desk top. The pad is also formed from a cushioning material, such as foam rubber, to better cushion the hand and wrist during use of the mouse. In addition, the pad can be made readily removable from the mouse, since it can be attached by a standard hook and loop fastening system, e.g., VELCRO TM.

Thus, in a first aspect, the invention features a wrist protector for a computer mouse which includes a sized pad having an upper surface and a lower surface connected together by at least one side wall. A portion of the side wall is adapted for fixation to the computer mouse. The lower surface is formed from a planar friction-free material adapted to slide on a separate planar surface (e.g., a desk top, or mouse pad). The upper surface is formed from a cushioning material. The pad has a thickness which elevates a wrist placed on the pad from the separate planar surface. The pad is sized for fixation to the mouse, and is of sufficient length to hold a portion of the wrist of a hand holding a mouse fixed to the pad.

In preferred embodiments, the lower surface is formed from a polyethylene, such as ultra-high molecular weight plastic or polytetrafluoroethylene (PTFE, TEFLON TM); the pad is formed from a cushioning rubber; the upper surface is formed from a fabric material; the pad is provided with a hook and loop fastening system, such as VELCRO TM, to allow connection to the computer mouse; and the pad is provided as a generally rectangular or square piece of material having a length and width between about 2 and 4 inches and a height of between approximately 0.25 and 0.75 inches.

In a related aspect, the invention features a computer mouse and a wrist protector. In this aspect, the above-described wrist protector is fixed to a computer mouse.

In another related aspect, the invention features a method for using a computer mouse by providing a wrist protector as described above and attaching it to the computer mouse. The computer mouse is used in a standard fashion with a wrist of the hand moving the computer mouse resting on the pad.

Other features and advantages of the invention will be apparent from the following description of the preferred embodiments thereof, and from the claims.

DESCRIPTION OF THE PREFERRED EMBODIMENTS

The drawings will first briefly be described.

DRAWINGS

FIG. 1 is a generally isometric view of a computer mouse and a wrist protector of the invention;

FIG. 2 is an isometric view of a wrist protector of the invention;

FIG. 3 is a top view of a wrist protector; and

FIG. 4 is a sectional view through a wrist protector.

STRUCTURE

Referring to FIG. 1 a computer mouse 12 is connected to a wrist protector 10 by a hook and loop fastening system shown generally by arrow 14. Fastening system 14 is formed from one portion of a hook and loop fastener fixed by adhesive to one side wall 13 of pad 10. The other portion of the fastener is similarly attached to computer mouse 12. In use, the computer mouse 12 is held by the hand of a person, and the wrist (and any other proximal portions of the arm and hand) are rested on pad 10. Since pad 10 has a slick lower surface it follows mouse 12 as it is moved by the hand of the user.

Referring to FIGS. 2, 3, and 4, pad 10 is formed of a generally square material having a 3.25" side, and ½" radius corners. It has a height of about 0.5". Upper surface 16 is formed from a thin portion of a fabric material which provides some friction and comfort to the wrist of the user. The undersurface (shown generally by arrow 18) is formed of a thickness D1 of 0.01" thick self-lubricating ultra-high molecular weight polyethylene (molecular weight about 4–6 million, obtained from AIN Plastics, Massachusettes.). Between upper surface 16 and lower surface 18 is a foam rubber portion 20, having a thickness D2 of approximately 0.5".

The ultra-high molecular weight polyethylene can be replaced with any other similarly friction-free material having a low coefficient of friction, and providing a slick surface on the lower portion of the pad. It should be of a high durability. Similarly, the hook and loop fastener may be replaced with any other type of fastening system, and may even be formed from a permanently fastenable material, such as adhesive. The pad may be shaped to completely surround a mouse if desired.

The pad is assembled and manufactured by standard techniques.

Other embodiments are within the following claims.

I claim:

1. A mouse and wrist protector, comprising:

a computer mouse fixedly connected to a sized pad having an upper surface and a lower surface connected together by at least one side wall, a portion of said side wall being fixed to said computer mouse by a hook and loop fastening means, said lower surface being formed from a planar friction-free material adapted to slide on a separate planar surface, said upper surface being formed from a cushioning material, said pad having a thickness which elevates a wrist placed on said pad from the separate planar surface, said pad being sized for fixation to the mouse and being of sufficient length and width to hold a portion of the wrist of a hand holding said mouse.

2. The wrist protector of claim 1 wherein said lower surface comprises ultra-high molecular weight plastic.

3. The wrist protector of claim 2 wherein said plastic is polyethylene.

4. The wrist protector of claim 1 wherein said pad comprises rubber.

5. The wrist protector of claim 1 wherein said upper surface comprises a fabric.

6. The wrist protector of claim 1 wherein said sized pad is rectangular having a width and length of between two and four inches.

7. The wrist protector of claim 1, wherein said lower surface comprises PTFE.

* * * * *